US006251199B1

(12) United States Patent
Mandigo et al.

(10) Patent No.: US 6,251,199 B1
(45) Date of Patent: Jun. 26, 2001

(54) COPPER ALLOY HAVING IMPROVED RESISTANCE TO CRACKING DUE TO LOCALIZED STRESS

(75) Inventors: Frank N. Mandigo, North Branford; John F. Breedis, Trumbull, both of CT (US)

(73) Assignee: Olin Corporation, New Haven, CT (US)

( * ) Notice: Subject to any disclaimer, the term of this patent is extended or adjusted under 35 U.S.C. 154(b) by 0 days.

(21) Appl. No.: 09/304,803

(22) Filed: May 4, 1999

(51) Int. Cl.[7] ..... C22C 9/02

(52) U.S. Cl. ..... 148/433; 148/544; 148/685; 420/473

(58) Field of Search ..... 148/433, 544, 148/685; 420/473

(56) References Cited

U.S. PATENT DOCUMENTS

| | | | |
|---|---|---|---|
| 1,976,803 | 10/1934 | Price | 75/1 |
| 2,185,957 | 1/1940 | Strang et al. | 75/159 |
| 2,744,822 | 5/1956 | Briggs, Jr. et al. | 75/159 |
| 3,988,176 | 10/1976 | Watanabe et al. | 148/32 |
| 4,337,089 | 6/1982 | Arita et al. | 420/472 |
| 4,466,939 | 8/1984 | Kim et al. | 420/485 |
| 4,589,938 | 5/1986 | Drosdick | 148/435 |
| 4,591,484 | 5/1986 | Miyafuji et al. | 420/481 |
| 4,594,221 | 6/1986 | Caron et al. | 420/485 |
| 4,612,167 | 9/1986 | Watanabe et al. | 420/471 |
| 4,656,003 | 4/1987 | Miyafuji et al. | 420/473 |
| 4,696,704 | 9/1987 | Takeuchi et al. | 148/412 |
| 4,728,372 | 3/1988 | Caron et al. | 148/2 |
| 4,732,731 | 3/1988 | Asai et al. | 420/473 |
| 4,935,202 | 6/1990 | Iwadachi | 420/486 |
| 4,971,758 | 11/1990 | Suzuki et al. | 420/472 |
| 5,021,105 | 6/1991 | Asai et al. | 148/433 |
| 5,024,814 | 6/1991 | Futatasuka et al. | 420/473 |
| 5,041,176 | 8/1991 | Mikawa | 148/412 |
| 5,089,057 | 2/1992 | Plewes | 148/12.7 |
| 5,124,124 | 6/1992 | Ohashi et al. | 420/473 |
| 5,215,711 | 6/1993 | Mikawa | 420/487 |
| 5,250,256 | 10/1993 | Ohashi et al. | 420/473 |
| 5,334,346 | 8/1994 | Kim et al. | 420/4.85 |
| 5,424,030 | 6/1995 | Takahashi | 420/473 |

(List continued on next page.)

FOREIGN PATENT DOCUMENTS

| | | | |
|---|---|---|---|
| 0 189 745 | | 6/1986 | (EP) . |
| 1514147 | | 6/1978 | (GB) . |
| 58-123846 | * | 7/1983 | (JP) . |
| 61-243141 | * | 10/1986 | (JP) . |
| 63-192835 | | 8/1988 | (JP) . |
| 3188247 | * | 8/1991 | (JP) . |
| 5-179377 | | 7/1993 | (JP) . |
| 6041660 | * | 2/1994 | (JP) . |

OTHER PUBLICATIONS

Standard Designations for Wrought and Cast Copper and Copper Alloys, Application Data Sheet, by Copper Development Association Inc., 260 Madison Avenue, New York, NY 10016, Revised Jul., 1998; pp. 1–20.

*Primary Examiner*—Sikyin Ip
(74) *Attorney, Agent, or Firm*—Gregory S. Rosenblatt; Wiggin & Dana

(57) ABSTRACT

A copper alloy having improved resistance to cracking due to localized plastic deformation and the process of making it. The alloy consists essentially of: from 0.7 to 3.5 weight percent nickel; from 0.2 to 1 weight percent silicon; from 0.05 to 1 weight percent tin; from 0.26 to 1 weight percent iron; and the balance copper and unavoidable impurities. The copper alloy has a local ductility index of greater than 0.7 and a tensile elongation exceeding 5%. Cobalt may be substituted for iron, in whole or in part, on a 1:1 basis by weight. The alloy is precipitation hardenable and useful for electronic applications, including without limitation, connectors.

37 Claims, 3 Drawing Sheets

U.S. PATENT DOCUMENTS

Figure 1:
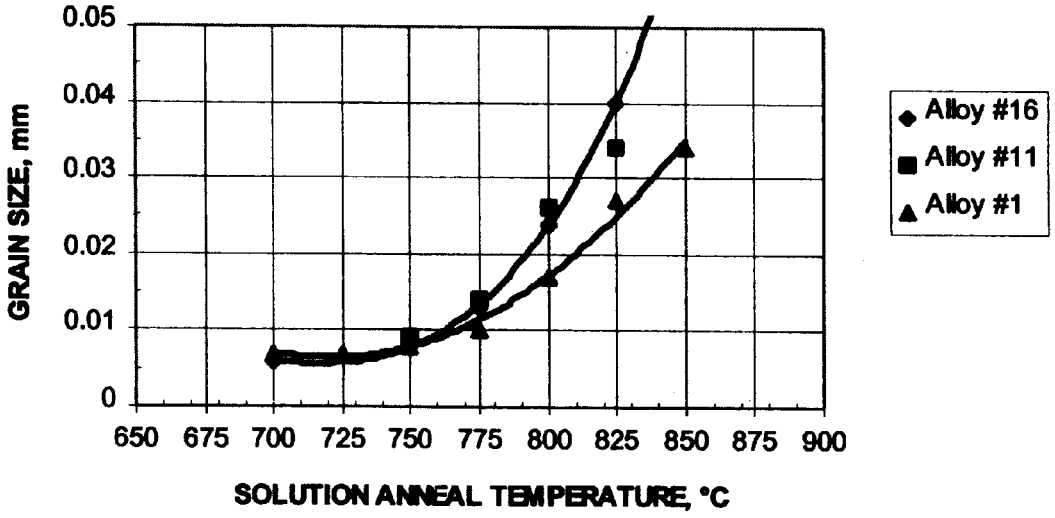

| | | | |
|---|---|---|---|
| 5,508,001 | 4/1996 | Suzuki et al. | 420/472 |
| 5,516,484 | 5/1996 | Kubosono et al. | 420/469 |
| 5,565,045 | 10/1996 | Caron et al. | 148/432 |
| 5,675,883 | 10/1997 | Gaag et al. | 29/527.7 |
| 5,824,167 | 10/1998 | Ishikawa et al. | 148/435 |
| 5,843,243 | 12/1998 | Kawasaki et al. | 148/435 |
| 5,846,346 | 12/1998 | Lee et al. | 148/433 |
| 5,853,505 | 12/1998 | Brauer et al. | 148/433 |
| 5,868,877 | 2/1999 | Brenneman | 148/432 |

* cited by examiner

COPPER ALLOY HAVING IMPROVED RESISTANCE TO CRACKING DUE TO LOCALIZED STRESS

BACKGROUND OF THE INVENTION

1. Field of the Invention

This invention relates to copper base alloys having particular application as connectors or lead frames in electronics. The alloy of this invention comprises a precipitation hardenable nickel-silicon-tin copper alloy to which iron is added within certain limits. The alloy provides improved resistance to cracking or fracture during localized plastic deformation, a fine grain size and improved resistance to grain growth at elevated temperatures. The alloy also provides an excellent combination of properties including bend formability, high strength, stampability and improved resistance to stress relaxation at elevated temperatures.

2. Description of Related Art

One copper alloy used to manufacture electrical connector or leadframe electronic components is designated by the Copper Development Association (CDA, New York, N.Y.) as copper alloy C70250. Copper alloy C70250 has the nominal composition, by weight, of 2.2%–4.2% nickel, 0.25%–1.2% silicon, 0.05%–0.30% magnesium, 0.2% max iron, 1.0% max zinc, 0.1% max manganese, 0.05% max lead and the balance copper and unavoidable impurities. Further details concerning alloys of this type can be found in U.S. Pat. Nos. 4,594,221 and 4,728,372 to Caron et al. Both of which are incorporated by reference in their entireties herein.

United States patents that disclose copper alloys containing nickel, silicon, tin and iron, include U.S. Pat. Nos. 4,971,758 to Suzuki et al., 5,024,814 to Futatasuka et al. and 5,508,001 to Suzuki et al. All of which are incorporated by reference in their entireties herein. U.S. Pat. No. 5,846,346 discloses a copper alloy containing nickel, silicon, tin and an optional addition of iron.

While copper alloys containing nickel, silicon, tin and iron within certain limits are known, there remains a need for a copper alloy with an improved resistance to cracking or fracture during localized plastic deformation, a fine grain size and improved resistance to grain growth at elevated temperatures while maintaining an excellent combination of properties including bend formability, high strength, stampability and improved resistance to stress relaxation at elevated temperatures.

SUMMARY OF THE INVENTION

The design of electrical/electronic connectors, particularly for use in the automotive industry, has become much more complex and miniaturized. This has imposed increasingly higher formability demands on the copper alloys from which they are made. For example, box type connectors include transitions from the box type socket to the wire crimp portion wherein the copper alloy is subjected to localized plastic deformation due to a combination of bending and stretching. Typical prior art measures of tensile elongation and minimum bend radius have surprisingly been found to inadequately predict the performance of copper alloys when subjected to such localized plastic deformation. As a result, copper alloys which have excellent tensile elongation and bend formability as measured by the minimum bend radius, have failed in such applications due to a propensity for cracking under such localized plastic deformation.

In accordance with this invention, applicants have developed a local ductility index which enables one to predict whether a copper alloy will be suitable for applications which will require localized plastic deformation of the alloy. It has surprisingly been found that a precipitation hardenable nickel-silicon-tin copper alloy to which iron is added within certain limits provides such improved resistance to cracking or fracture during localized plastic deformation. The alloy of this invention also has a fine grain size and improved resistance to grain growth at elevated processing temperatures. The alloy also provides an excellent combination of properties including excellent bend formability, high strength, excellent stampability and improved resistance to stress relaxation at elevated temperatures. The alloy preferably provides an improved solution anneal processing window and a more stable response to age annealing at finished strip thickness.

In accordance with this invention a copper alloy is provided having improved resistance to cracking due to localized plastic deformation. The alloy consists essentially of: from 0.7 to 3.5 weight percent nickel; from 0.2 to 1 weight percent silicon; from 0.05 to 1 weight percent tin; from 0.26 to 1 weight percent iron; and the balance copper and unavoidable impurities. The copper alloy has a local ductility index of greater than 0.7 and a tensile elongation exceeding 5%.

In a preferred embodiment of this invention, nickel is from 1.2 to 2.8 weight percent, silicon is from 0.3 to 0.7 weight percent, tin is from 0.2 to 0.6 weight percent, iron is from 0.28 to 0.7 weight percent and the alloy further includes an effective amount of manganese for improving hot workability up to 0.15 weight percent. In a more preferred embodiment of this invention, nickel is from 1.5 to 2.5 weight percent, silicon is from 0.35 to 0.55 weight percent, tin is from 0.3 to 0.5 weight percent, iron is from 0.3 to 0.5 weight percent and manganese is from 0.02 to 0.1 weight percent.

In accordance with an alternative embodiment of this invention cobalt may be substituted, in whole or in part, on a 1:1 basis by weight for iron to improve resistance to grain growth at elevated temperatures and improved aging response.

The copper alloys of this invention generally possess a yield strength of from 60 to 100 ksi, an electrical conductivity of greater than or equal to 35% IACS, stress relaxation resistance at 150° centigrade of at least 80% longitudinal stress remaining after 3000 hours exposure and excellent bend formability. The alloys of this invention are particularly useful in electrical or electronic connector applications, although they may be used in any application where their unique combination of properties make them suitable, such as without limitation, lead frames, or other electronic uses.

An electrical connector formed from the copper alloy of this invention also forms part of this invention.

The process for making the alloy of this invention also forms a part of the invention. The critical minimum amount of iron used in the alloys of the present invention avoids cracking problems during hot working as the temperature of the strip falls during succeeding hot rolling passes. This results in a significant improvement in hot workability for the alloys of this invention and provides a broad processing window, which increases productivity by increasing the manufacturing yield from the hot working operation.

Accordingly it is an aim of the present invention to provide an improved copper base alloy and the process for making it, which will provide an alloy having increased resistance to cracking during localized plastic deformation.

It is a further aim of this invention to provide a precipitation hardenable nickel-silicon-tin copper alloy to which iron is added within certain limits.

It is a still further aim of this invention, in accordance with a preferred embodiment thereof, to provide an alloy which has an excellent combination of properties including, fine grain size, excellent bend formability, high strength, excellent stampability and improved resistance to stress relaxation at elevated temperatures.

It is a still further aim of this invention, in accordance with a preferred embodiment thereof, to provide an alloy with a large solution anneal processing window and a more stable response to age annealing at finish gauge.

The above stated objects, features and advantages will become more apparent from the specification and drawings that follow.

IN THE DRAWINGS

FIG. 1 graphically illustrates the effect of iron in the alloys of this invention, for improving resistance to grain growth at elevated solution annealing temperatures.

Figure 2:
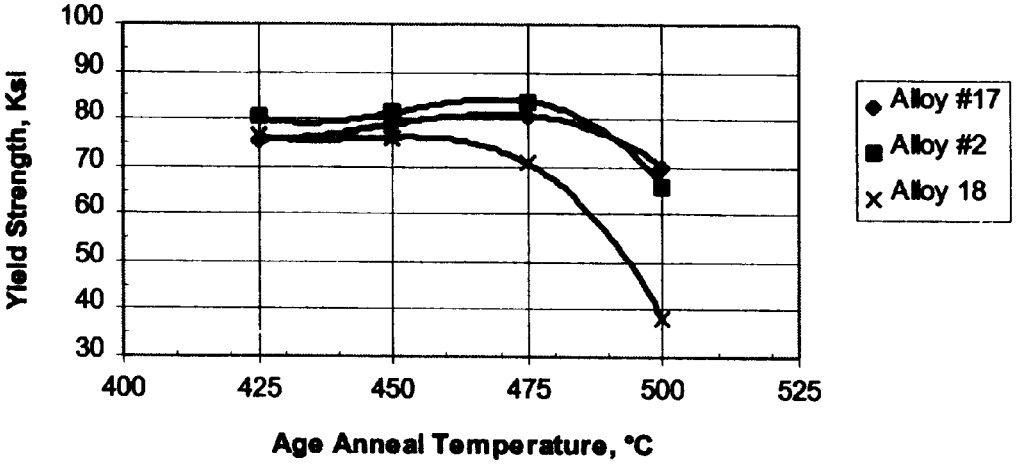

FIG. 2 graphically compares the effect of the iron content of an alloy of this invention on the aging response of the alloy.

Figure 3:
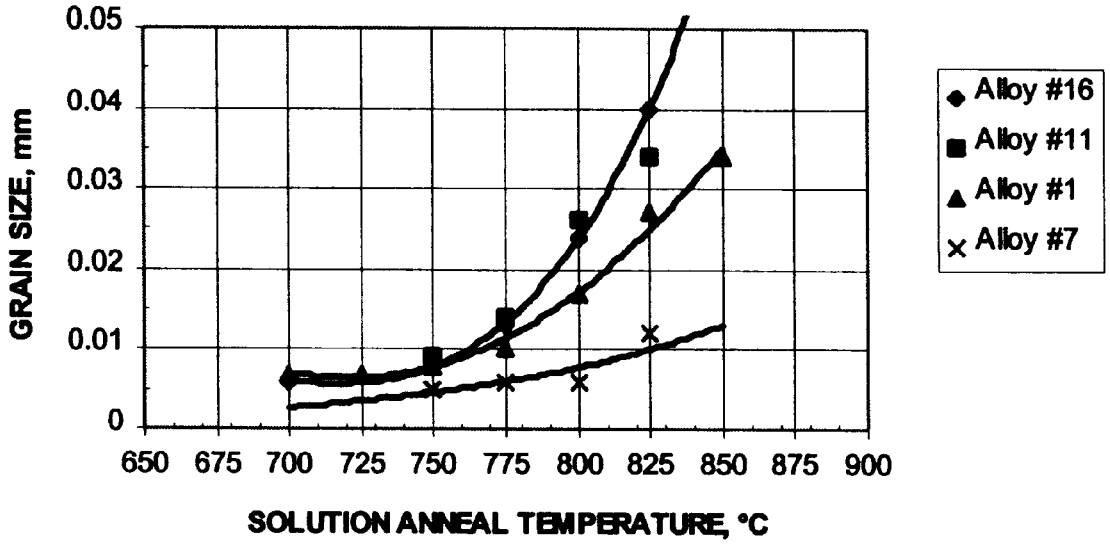

FIG. 3 graphically illustrates the effect of substituting cobalt for iron in the alloys of this invention, for improving resistance to grain growth at elevated solution annealing temperatures.

Figure 4:
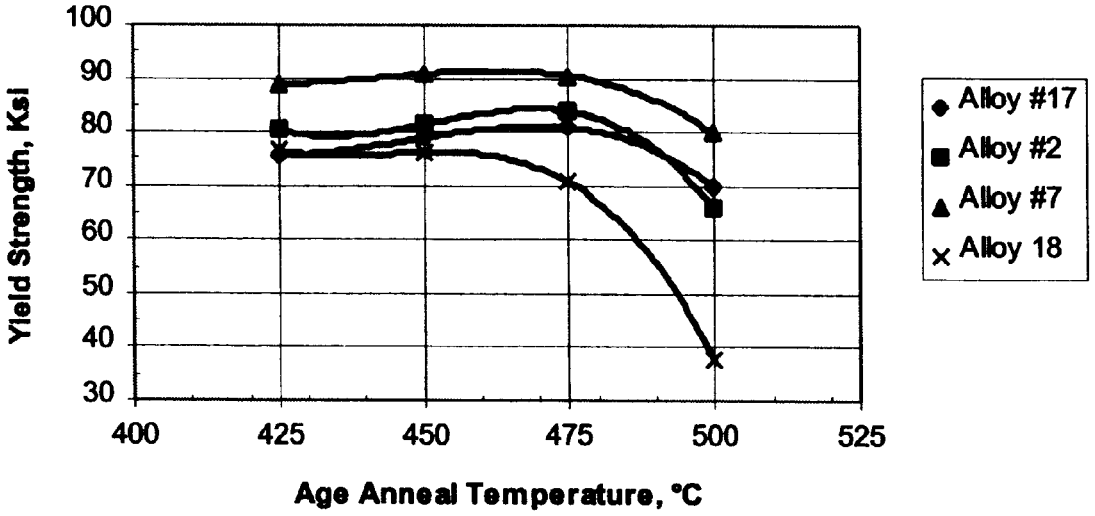

FIG. 4 graphically illustrates the effect of substituting cobalt for iron in the alloys of this invention on the aging response of the alloy.

Figure 5:
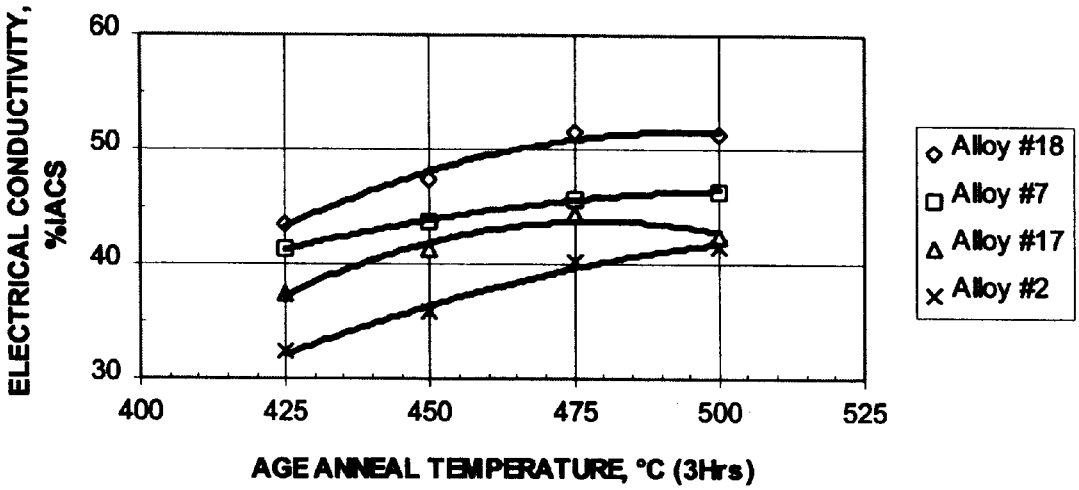

FIG. 5 graphically illustrates the effect of aging temperature on electrical conductivity for a range of alloys.

DETAILED DESCRIPTION

As used herein, IACS stands for International Annealed Copper Standard and assigns "pure" copper an electrical conductivity value of 100% IACS at 20° C.

The design of electrical/electronic connectors, particularly for use in the automotive industry, has become much more complex and has imposed increasingly higher formability demands on the copper alloys from which they are made. For example, box type connectors include transitions from the box type socket to the lead attachment portion wherein the copper alloy is subjected to localized plastic deformation due to a combination of bending and stretching. Localized plastic deformation comprises deformation during which plastic flow is non-uniform and necking occurs. Necking comprises localized thinning that occurs during sheet metal forming prior to fracture. Typical prior art measures of tensile elongation and minimum bend radius have surprisingly been found to inadequately predict the performance of copper alloys when subjected to such localized plastic deformation. As a result, copper alloys which have excellent tensile elongation and bend formability as measured by the minimum bend radius, have failed in such applications due to a propensity for cracking under such localized plastic deformation.

In accordance with this invention applicants have developed a local ductility index which enables one to predict whether a copper alloy will be suitable for applications which will require localized plastic deformation of the alloy. The local ductility index of a copper alloy is determined by running a conventional tensile test using a strip type tensile specimen having a desired length, width and thickness. For purposes of example, the dimensions of a typical tensile test specimen used to determine the local ductility index are a gauge length of 2 inches, a width of 0.5 inches and a desired thickness which ranges from about 0.005 to about 0.025 inches. The tensile test specimen is placed in a conventional tensile test machine such as an Instron® tensile tester. A conventional tensile test for generating a stress strain diagram is run up to the fracture of the specimen. The thickness of the specimen at the fracture is then measured. The local ductility index is then computed as follows:

$$\frac{T_1 - T_2}{T_1} = LDI$$

where:

$T_1$=the original thickness of the tensile specimen, $T_2$=the thickness of the tensile specimen at its fractured end, and LDI the local ductility index of the alloy.

Elemental copper has a very high electrical conductivity and relatively low strength and poor resistance to stress relaxation. Stress relaxation is an important consideration when selecting a copper alloy for an application where the product will be subjected to external stresses, such as when used as a spring or an electrical connector component.

Stress relaxation is a phenomenon that occurs when an external elastic stress is applied to a piece of metal. The metal reacts by developing an equal and opposite internal elastic stress. If the metal is restrained in the stressed position, the internal elastic stress decreases as a function of time. The gradual decrease in internal elastic stress is called stress relaxation and happens because of the replacement of elastic strain in the metal, by plastic or permanent strain. The rate of decrease of internal stress with time is a function of alloy composition, alloy temper, orientation relative to processing direction (e.g. longitudinal orientation=the rolling direction) and exposure temperature. It is desirable to reduce the rate of decrease, i.e. to increase the resistance to stress relaxation, as much as possible for spring and connector applications.

In the manufacture of an electrical connector, a sheet of copper alloy may be formed into a hollow shape for use as a socket. In the automotive field, box shaped sockets have found particular application. Metal adjacent to an open end of the copper alloy socket is externally stressed, such as by bending, to develop an opposing internal stress effective to cause the end of the copper alloy socket to bias inwardly and tightly engage or contact a mating plug. This tight engagement insures that the electrical resistance across the socket and plug connector components remains relatively constant and that, in extreme conditions, the plug resists separation from the socket.

Over time, and more rapidly at higher temperatures, stress relaxation weakens the contact force between the socket and the plug and may eventually lead to connector failure. It is a primary objective of electrical connector design to maximize the contact force between the socket and the plug to maintain good electrical conductivity through the connector.

Bend formability is most often described it terms of minimum bend radius ("MBR") which is that radius about which a metal can be bent without exhibiting fracture. The minimum bend radius as used herein is the radius of a mandrel around which a strip can be bent about 90° without evidence of cracking. MBR is usually stated in terms multiples of the thickness "t" of the sheet being tested. For example MBR's of "1t" or less are highly desired for connector applications. When a sheet of copper alloy is reduced in thickness by passing it through the rolls of a rolling mill the copper alloy sheet has different bend properties or MBR's, about an axis transverse to the direction of rolling ("good way bends" or "GW") or about an axis parallel to the direction of rolling ("bad way bends" or "BW").

It has surprisingly been found that a precipitation hardenable nickel-silicon-tin copper alloy to which iron is added within certain limits provides such improved resistance to cracking or fracture during localized plastic deformation. The alloy of this invention also has a fine grain size and improved resistance to grain growth at elevated temperatures. The alloy also provides an excellent combination of properties including excellent bend formability, high strength, excellent stampability and improved resistance to stress relaxation at elevated temperatures. The alloy preferably provides an improved solution anneal processing window and a more stable response to age annealing at finish gauge.

In accordance with this invention a copper alloy is provided having improved resistance to cracking due to localized plastic deformation. The alloy consists essentially of: from 0.7 to 3.5 weight percent nickel; from 0.2 to 1 weight percent silicon; from 0.05 to 1 weight percent tin; from 0.26 to 1 weight percent iron; and the balance copper and unavoidable impurities. The copper alloy has a local ductility index of greater than 0.7 and a tensile elongation exceeding 5% in a 2" gauge length.

In a preferred embodiment of this invention, nickel is from 1.2 to 2.8 weight percent, silicon is from 0.3 to 0.7 weight percent, tin is from 0.2 to 0.6 weight percent, iron is from 0.28 to 0.7 weight percent and the alloy further includes an effective amount of manganese for improving hot workability up to 0.15 weight percent. In a more preferred embodiment of this invention, nickel is from 1.5 to 2.5 weight percent, silicon is from 0.35 to 0.55 weight percent, tin is from 0.3 to 0.5 weight percent, iron is from 0.3 to 0.5 weight percent and manganese is from 0.02 to 0.1 weight percent.

Preferably the ratio of nickel to silicon in the alloys of this invention is greater than about 4.5 to 1 and most preferably greater than about 5 to 1.

In accordance with an alternative embodiment of this invention cobalt may be substituted, in whole or in part, on a 1:1 basis by weight, for iron, to improve resistance to grain growth at elevated temperatures and improve aging response. In a most preferred embodiment of the alloys of this invention the total content of nickel, iron and cobalt is less than about 2.5% by weight.

The copper alloys of this invention generally possess a yield strength of from 60 to 100 ksi, an electrical conductivity of greater than or equal to 35% IACS, stress relaxation resistance comprising the stress remaining after 3000 hours exposure at 150° centigrade of at least 80% longitudinal and excellent bend formability. The alloys of this invention are particularly useful in electrical or electronic connector applications, although they may be used in any application where their unique combination of properties make them suitable, such as without limitation, lead frames, or other electronic uses.

An electrical connector formed from the copper alloy of this invention and the process for making the alloy form part of this invention.

The alloys of this invention achieve their unique properties by balancing solid solution strengthening, dispersion strengthening, and precipitation hardening. They show excellent hot and cold workability.

The alloys of this invention can be prepared by conventional induction melting and semi-continuous casting, followed by hot and cold rolling with appropriate intermediate and finish gauge annealing treatments. Alternatively they can be prepared by strip casting and cold rolling with appropriate intermediate and finish gauge annealing treatments.

The alloys of this invention can be cast by any desired conventional casting process such as, without limitation, direct chill semicontinuous casting or strip casting. If not strip cast, the alloys are preferably hot rolled at a starting temperature in the range of about 750° C. to 950° C. and most preferably in the range of about 825° C. to 925° C. Thereafter the alloys are preferably subjected to an optional bell anneal at a temperature in the range of about 400° C. to 700° C. and most preferably about 550° C. to 650° C., for a period of about 1 hour to 16 hours and most preferably about 3 hours to 6 hours. In the case of strip cast alloys this bell anneal is usually not required.

The alloys of this invention are then preferably cold rolled from about 50% to 90% reduction in thickness. Following cold reduction, in accordance with a first embodiment of the process of this invention, the alloys are preferably solution annealed by a strip anneal at a metal temperature of about 700° C. to 900° C. and most preferably from about 750° C. to 850° C. for a period of up to 5 minutes and most preferably for a period of 30 to 60 seconds. Alternatively following cold reduction in accordance with a second embodiment of the process of this invention, the alloys may be bell annealed at a temperature in the range of about 400° C. to 700° C. and most preferably about 450° C. to 600° C., for a period of about 1 hour to 6 hours.

The alloys in accordance with the first process embodiment may or may not then be finally cold rolled up to about a 50% reduction in thickness to finished gauge, depending on the desired temper. For a first preferred temper the final cold rolling is preferably in the range of from about 10% to 20% reduction in thickness. For a preferred second temper the final cold rolling is preferably in the range of from about 30% to 50% reduction in thickness. The alloys in accordance with the second process embodiment are then preferably finally cold rolled from about 30% to about 50% reduction in thickness.

The alloys in accordance with the first process embodiment are then preferably aged by bell annealing in the range of about 400° C. to 550° C. and most preferably in the range from about 400° C. to 500° C. for a period of about 1 hour to 6 hours and most preferably about 2 hours to 4 hours. The alloys in accordance with the second process embodiment are then preferably relief annealed at a metal temperature in the range of about 250° C. to 350° C. for about 30 seconds to about 5 hours.

The first process embodiment of this invention should provide a copper alloy of this invention with higher strength and somewhat reduced electrical conductivity and bend formability as compared to an alloy of this invention processed in accordance with the alternative second process embodiment. The second process embodiment of this invention should provide a copper alloy of this invention with higher electrical conductivity and bend formability and somewhat reduced strength as compared to an alloy of this invention processed in accordance with the alternative first process embodiment.

EXAMPLES

The improved properties of the alloys of this invention will now be illustrated by the examples which follow. A series of copper alloys having the nominal compositions set forth in Table 1 were prepared, unless otherwise noted, using the most preferred first process embodiment described above.

TABLE 1

| | |
|---|---|
| Alloy #1: | 1.54% Ni, 0.42% Si, 0.41% Sn, 0.37% Fe |
| Alloy #2: | 1.53% Ni, 0.42% Si, 0.35% Sn, 0.60% Fe |
| Alloy #3: | 1.82% Ni, 0.40% Si, 0.35% Sn, 0.45% Fe |
| Alloy #4: | 1.63% Ni, 0.46% Si, 0.37% Sn, 0.39% Fe |
| Alloy #5: | 2.09% Ni, 0.46% Si, 0.34% Sn, 0.43% Fe |
| Alloy #6: | 2.04% Ni, 0.58% Si, 0.34% Sn, 0.43% Fe |
| Alloy #7: | 1.54% Ni, 0.30% Si, 0.39% Sn, 0.22% Co |
| Alloy #8: | 1.97% Ni, 0.51% Si |
| Alloy #9: | 2.5% Ni, 0.60% Si |
| Alloy #10: | 2.0% Ni, 0.40% Si, 0.34% Sn |
| Alloy #11: | 1.55% Ni, 0.29% Si, 0.29% Sn |
| Alloy #12: | 2.04% Ni, 0.38% Si, 0.37% Sn |
| Alloy #13: | 1.81% Ni, 0.44% Si, 0.63% Fe |
| Alloy #14: | 1.63% Ni, 0.46% Si, 0.37% Sn, 0.39% Fe |
| Alloy #15: | 1.63% Ni, 0.46% Si, 0.37% Sn, 0.39% Fe |
| Alloy #16: | 1.50% Ni, 0.31% Si |

TABLE 1-continued

| | |
|---|---|
| Alloy #17: | 1.53% Ni, 0.32% Si, 0.36% Sn, 0.32% Fe |
| Alloy #18: | 1.51% Ni, 0.31% Si, 0.38% Sn |

The balance for the alloys in the Table 1 comprises copper and unavoidable impurities. Alloys 1–7, 14, 15 and 17 comprise alloys in accordance with this invention. Alloys 8–13, 16 and 18 comprise prior art alloys which are presented for comparison purposes. Referring now to Tables 2 and 3 the properties of alloys 1–15 are set forth for one or more different cold reductions.

TABLE 2

PROPERTIES OF THE ALLOYS OF THIS INVENTION

| Alloy | % Cold Reduction | Grain Size, mm RF | Tensile Properties YS/UTS/% Elong. | % IACS | 90° MBR/t GW/BW | 3000 Hour % Stress Remaining 125° C. | 150° C. | 175° C. |
|---|---|---|---|---|---|---|---|---|
| Alloy #1 | 15% CR | 0.008 mm | 74.7/82.3/12 | 38.1% | 0.8t/0.3t | 90.9 | N/A | N/A |
| | 50% CR | 0.006 mm | 84.0/90.6/10 | 40.1% | 0.8t/0.6t | 89.1 | N/A | N/A |
| Alloy #2 | 15% CR | 0.007 mm | 71.2/80.5/15 | 37.4% | 0.8t/0.6t | N/A | N/A | N/A |
| | 50% CR | 0.009 mm | 82.2/86.0/10 | 38.6% | 0.8t/0.3t | 90.3 | 84.4 | N/A |
| Alloy #3 | 50% CR | 0.006 mm | 86.1/93.1/8 | 41.1% | 1.1t/0.4t | N/A | N/A | N/A |
| Alloy #4 | 50% CR | 0.012 mm | 85.7/93.7/8 | 41.5% | 1.8t/0.6t | N/A | N/A | N/A |
| Alloy #5 | 50% CR | 0.005 mm | 83.5/92.1/9 | 42.4% | 1.2t/0.6t | N/A | N/A | N/A |
| Alloy #6 | 50% CR | 0.006 mm | 94.2/100.9/8 | 43.1% | 1.8t/0.9t | N/A | N/A | N/A |
| Alloy #7 | 50% CR | 0.012 mm | 91.2/98.4/8 | 44.5% | 1.4t/0.6t | N/A | N/A | N/A |
| Alloy #14 | 20% CR | 0.007 mm | 75.5/82.6/8 | 41.5% | 0.8t/0.3t | 90.1 | 80.9 | N/A |
| Alloy #15 | 20% CR | 0.007 mm | 85.1/92.1/9 | 40.3% | 1.6t/0.5t | 89.6 | 80.2 | 71.9 |
| | 50% CR | 0.008 mm | 91.5/98.2/8 | 39.3% | 1.8t/0.8t | 90.0 | 82.0 | 76.7 |
| Alloy #17 | 40% CR | 0.012 mm | 76.6/83.7/9 | 41.2% | 1.4t/0.6t | N/A | N/A | N/A |

N/A = Not Available
CR = Cold Reduction
RF = Annealed condition prior to final cold working step.

TABLE 3

PROPERTIES OF COMPARISON ALLOYS

| Alloy | % Cold Reduction | Grain Size, mm RF | Tensile Properties YS/UTS/% Elong. | % IACS | 90° MBR/t GW/BW | 3000 Hour % Stress Remaining 125° C. | 150° C. |
|---|---|---|---|---|---|---|---|
| Alloy #8 | 0% CR | 0.027 mm | 62/93/13 | 38% | 0.9t/Sharp | 81.0 | N/A |
| | 15% CR | 0.028 mm | 82/95/10 | 43% | 1.8t/0.9t | 76.0 | 64.0 |
| | 50% CR | 0.020 mm | 91/99/8 | 45% | 2.0t/1.4t | 78.0 | N/A |
| Alloy #9 | 15% CR | 0.009 mm | 91/105/11 | 46% | 2.0t/0.3t | 82.0 | 74.0 |
| Alloy #10 | 0% CR | 0.015 mm | 57/90/22 | 41% | 0.9t/Sharp | N/A | N/A |
| | 15% CR | 0.011 mm | 87/100/13 | 40% | 1.4t/0.6t | 88.0 | 78.0 |
| Alloy #11 | 15% CR | 0.010 mm | 76/90/17 | 40% | 0.8t/0.5t | N/A | N/A |
| | 50% CR | 0.008 mm | 89/96/11 | 43% | 1.2t/0.6t | 86.7 | 77.4 |
| Alloy #12 | 15% CR | 0.007 mm | 78/85/11 | 42% | 0.6t/0.3t | N/A | N/A |
| | 50% CR | 0.008 mm | 88/95/8 | 44% | 0.9t/0.8t | 86.7 | 77.4 |
| Alloy #13 | 15% CR | N/A | | | | | |
| | 50% CR | 0.008 mm | 77/85/9 | 45% | 1.2t/0.3t | N/A | N/A |
| Alloy #16 | 15% CR | 0.014 mm | 56.8/66.3/11 | 47.4% | N/A | N/A | N/A |
| | 50% CR | 0.022 mm | 77.2/83.8/7 | 45.7% | N/A | N/A | N/A |
| Alloy #18 | 40% CR | 0.008 mm | 76.5/84.7/9 | 49.2% | 1.2t/0.5t | N/A | N/A |

N/A = Not Available
CR = Cold Reduction
RF = Annealed condition prior to final cold working step.

The alloys of this invention, as for example, Alloys 2, 14 and 15 in Table 2, provide significantly improved stress relaxation resistance when compared to alloys without tin or iron additions (alloy 8 and alloy 9 in Table 3) or alloys with tin but with no Fe (alloy 10, alloy 11, and alloy 12 in Table 3). The stress relaxation data also show that the benefits offered by the iron addition within the ranges of this invention, increase as test temperature increase from 125° C. to 150° C. For example, Alloy 2 of this invention with an addition of 0.60% by weight iron shows an increase in stress relaxation resistance as compared to Alloy 11 of the prior art, which goes from about 77% stress remaining for Alloy 11 to 84% for Alloy 2, after a 3000 Hr exposure to a 150° C. test temperature. Alloy 15 shows a remarkable level of stress relaxation resistance at the even higher temperature of 175° C. It is surprising that this improvement in stress relaxation performance for the alloys of this invention is achieved while maintaining a grain size of about 0.010 mm. Such a fine grain size is desirable to provide the optimum combination of strength, bend formability and stampability.

As shown in Table 2 the alloys of this invention have a fine grain size and also provide an excellent combination of properties including excellent bend formability, high strength, excellent stampability and improved resistance to stress relaxation at elevated temperatures. The grain size of the alloys of this invention is preferably maintained at less than 0.015 mm. and most preferably at less than 0.010 mm.

In order to illustrate the improved resistance to cracking due to localized plastic deformation of the alloys of this invention a series of alloys as set forth in Table 4 were subjected to tensile testing and their local ductility index determined. Additional samples of each of the alloys were stamped into box connectors at a commercial connector stamping manufacturer, using a tool specially designed to amplify cracking tendency and were examined after stamping to determine if cracks were present.

TABLE 4

| | |
|---|---|
| Alloy A: | 1.54% Ni, 0.42% Si, 0.41% Sn, 0.37% Fe |
| Alloy B: | 1.54% Ni, 0.42% Si, 0.41% Sn, 0.37% Fe |
| Alloy C: | 0.30% Be, 0.45% Co |
| Alloy D: | 3.3% Ni, 0.3% Si, 0.15% Mg |
| Alloy E: | 2.5% Ni, 0.5% Si, 0.15% Mg |
| Alloy F: | 0.6% Fe, 0.2% P, 0.05% Mg |
| Alloy G: | 0.6% Fe, 0.2% P, 0.05% Mg |

The balance for the alloys in the Table 4 comprises copper and unavoidable impurities.

Table 5 sets forth the mechanical properties of the alloys in Table 4. Table 6 shows the cracking performance of the alloys in Table 4 for 90° box type bends and for the localized plastic deformation regions of the connector between the box portion and the wing portions. Comparing alloys A and B of this invention to alloys F and G it is apparent that the alloys of this invention have significantly improved resistance to cracking during localized plastic deformation even though alloys F and G have good bend formability. Comparing alloys A and B of this invention to alloys C, D and E it is apparent that the alloys of this invention have significantly improved resistance to cracking during localized plastic deformation even though alloys C, D and E have comparable elongation. However, as shown in Table 5 the local ductility index or LDI is an excellent predictor of crack sensitivity during localized plastic deformation. A local ductility index or LDI of greater than 0.7 and most preferably at least 0.75 for the alloys of this invention in combination with a tensile elongation greater than 5% provides alloys with significantly reduced propensity for cracking when subjected to localized plastic deformation.

TABLE 5

MECHANICAL PROPERTIES

| Alloy | YS/UTS/% El | 90° GW/BW | LDI |
|---|---|---|---|
| A - | 77/86/14 | 0.6t/0.3t | 0.79 |
| B - | 83/89/9 | 0.6t/0.3t | 0.75 |
| C - | 90/109/14 | 1.9t/0.8t | 0.63 |
| D - | 92/98/9 | 1.2t/0.9t | 0.6 |
| E - | 99/107/10 | 1.8t/0.6t | 0.49 |
| F - | 64/65/3 | 0.7t/0.7t | 0.68 |
| G - | 63/66/5 | 0.7t/0.7t | 0.7 |

TABLE 6

APPEARANCE OF STAMPED PART

| | | Localized Plastic Deformation Regions | |
|---|---|---|---|
| Alloy | 90° Box Bends* | Box to Wing | Wing to Wing |
| A - | OK | OK | OK |
| B - | OK | OK | 1 of 48 cracked |
| C - | severe orange peel-no cracks | OK | OK |
| D - | small cracks | 5 of 26 cracked | 3 of 26 cracked |
| E - | open cracks | 27 of 46 cracked | 21 of 46 cracked |
| F - | BW cracks | 19 of 62 cracked | 19 of 62 cracked |
| G - | BW cracks | 17 of 64 cracked | 21 of 64 cracked |

*90° Bends in the tool = 1.2t GW/0.2t BW

Referring now to Tables 7–9 the surprising criticality of the lower limit of iron is clearly illustrated by reference to prior art alloys. A series of alloys having the compositions set forth in Tables 7–9 were prepared by chill casting in a steel mold to produce rectangular ingots 4" long by 4" wide by 1.7" thick. The longitudinal edges of the ingots were tapered by cutting 45° chamfers from both major faces of the ingot along both edges of the ingot so that only a small centrally extending portion of the original edges remains. The samples were then subjected to a series of hot rolling investigations.

The purpose of the tapering is to accentuate the tendency of the ingots to exhibit cracking during hot rolling. It has been found that using tapered edge ingots as described, provides an excellent correlation with performance during commercial hot rolling. Tapered edge ingots which show cracks are a clear indication that such alloys will crack during commercial hot rolling. Tapered edge ingots that do not crack may in some cases exhibit cracks during commercial hot rolling. It is believed that cracking of a tapered edge ingot can be used to separate out alloys subject to significant cracking during hot rolling in the plant.

The alloys which were subjected to hot rolling are of the general composition of the alloys in U.S. Pat. No. 4,971,758 with varying levels of iron including 0% Fe as a control. In the referenced patent it is suggested at column 4, lines 5–9 that " . . . if the iron content exceeds 0.25%, the hot rolling property is no longer improved, but rather degraded . . . " (emphasis added). Contrary to these teachings as shown in Tables 8 and 9 a critical minimum amount of iron, as in accordance with the alloys of the present invention, is necessary to avoid cracking problems on hot working as the temperature of the strip falls during succeeding hot rolling passes.

TABLE 7

1st Hot Rolling Investigation

| Ingot ID | Ni | Si | Sn | Fe | Mn | Zn | P | Hot Roll Performance (Appearance of Taper Edges) 900° C./2 Hr Soak -- 15% Pass + 25% Pass + Water Quench Strip Thickness 1.70"→1.45" | 1.45"→1.08" |
|---|---|---|---|---|---|---|---|---|---|
| J1 | 1.84 | 0.54 | 0.42 | | | 0.32 | 0.007 | Ok | Ok |
| J5 | 1.84 | 0.5 | 0.42 | 0.09 | | 0.31 | 0.006 | Ok | Ok |
| J8 | 1.85 | 0.51 | 0.41 | 0.21 | | 0.31 | 0.007 | Ok | Ok |
| J10 | 1.85 | 0.54 | 0.42 | 0.32 | | 0.31 | 0.007 | Ok | Ok |
| J13 | 1.86 | 0.56 | 0.42 | 0.41 | | 0.31 | 0.007 | Ok | Ok |
| J16 | 1.87 | 0.54 | 0.41 | 0.51 | | 0.32 | 0.007 | Ok | Ok |
| J19 | 1.83 | 0.56 | 0.42 | 0.45 | 0.02 | 0.32 | 0.007 | Ok | Ok |
| Estimated Ingot Temperature, ° C. at beginning of hot rolling pass. | | | | | | | | 900° C. (actual) | About 825° C. |

Alloy compositions are set forth in weight percent.

TABLE 8

2nd Hot Rolling Investigation

| Ingot ID | Ni | Si | Sn | Fe | Mn | Zn | P | Hot Roll Performance (Appearance of Taper Edges) 900° C./2 Hr Soak -- Hot Roll Six Passes Without Reheat + Water Quench 1.70"→1.60" | 1.60"→1.35" | 1.35"→1.10" | 1.10"→0.90" | 0.90"→0.75" | 0.75"→0.50" |
|---|---|---|---|---|---|---|---|---|---|---|---|---|---|
| J2 | 1.83 | 0.53 | 0.43 | | | 0.32 | 0.006 | Ok | Ok | small cracks | small cracks | small cracks | 6 cracks one side |
| J6 | 1.85 | 0.51 | 0.42 | 0.09 | | 0.31 | 0.007 | Ok | Ok | one small crack | small cracks | small cracks | 2 cracks one side |
| J9 | 1.85 | 0.54 | 0.41 | 0.19 | | 0.31 | 0.007 | Ok | Ok | one small crack | small cracks | small cracks | 1 crack each side |
| J11 | 1.85 | 0.54 | 0.41 | 0.29 | | 0.31 | 0.007 | Ok | Ok | Ok | Ok | Ok | 1 crack one side |
| J15 | 1.87 | 0.54 | 0.41 | 0.43 | | 0.31 | 0.007 | Ok | Ok | Ok | Ok | Ok | Ok |
| J18 | 1.86 | 0.53 | 0.41 | 0.52 | | 0.31 | 0.007 | Ok | Ok | Ok | Ok | Ok | 2 cracks one side 1 crack one side |
| J20 | 1.87 | 0.54 | 0.4 | 0.44 | 0.02 | 0.31 | 0.007 | Ok | Ok | Ok | Ok | Ok | Ok |
| Estimated Ingot Temperature, ° C. at beginning of hot rolling pass | | | | | | | | 900° C. (actual) | About 825° C. | About 750° C. | About 675° C. | About 575° C. | About 450° C. |

Alloy compositions are in weight percent.

TABLE 9

3rd Hot Rolling Investigation

| Ingot ID | Ni | Si | Sn | Fe | Mn | Zn | P | Hot Roll Performance (Appearance of Taper Edges) 800° C./2 Hr Soak -- Hot Roll 15% + 25% + 25% + Water Quench 1.70"→1.45" | 1.45"→1.08" | 1.08"→0.81" |
|---|---|---|---|---|---|---|---|---|---|---|
| J3 | 1.84 | 0.52 | 0.42 | | | 0.32 | 0.007 | small cracks | cracks both sides | 7 large cracks (on both sides) |
| J4 | 1.84 | 0.53 | 0.42 | 0.12 | | 0.31 | 0.006 | Ok | one crack | 1 large crack one side |
| J7 | 1.84 | 0.5 | 0.41 | 0.17 | | 0.31 | 0.006 | Ok | Ok | Ok |
| J12 | 1.86 | 0.53 | 0.42 | 0.25 | | 0.31 | 0.007 | Ok | Ok | No Data |
| J14 | 1.86 | 0.54 | 0.42 | 0.35 | | 0.3 | 0.007 | Ok | Ok | Ok |
| J17 | 1.86 | 0.52 | 0.41 | 0.42 | | 0.31 | 0.007 | Ok | Ok | Ok |
| J21 | 1.87 | 0.5 | 0.41 | 0.45 | 0.02 | 0.31 | 0.007 | Ok | Ok | Ok |
| Estimated Ingot Temperature, ° C. at beginning of hot rolling pass | | | | | | | | 800° C. (actual) | About 725° C. | About 600° C. |

Alloy compositions are set forth in weight percent.

Table 7 shows that at relatively high hot working temperatures iron does not play a significant role in reducing cracking. Typical exit temperatures at the end of commercial hot rolling are often as low as about 600–650° C. The laboratory hot rolling process used to produce the results in Table 8 is believed to be the most similar to a commercial style process. The criticality of the lower limit of iron in accordance with the alloys of this invention is clearly shown in Table 8. The alloys of this invention are not subject to the kind of cracking that alloys with lower iron contents as suggested in the referenced patent exhibit in later hot rolling passes. This results in a significant improvement in hot workability for the alloys of this invention and provides a broad processing window, which increases productivity by increasing the manufacturing yield from the hot working operation.

When compared to CuNiSiSn alloys of the prior art the CuNiSiSnFe alloys in accordance with this invention provide two other significant process advantages, namely, a larger solution anneal process window and a more stable response to age annealing at finish gauge.

Referring to FIG. 1 there is shown a graph of solution anneal ("SA") temperature versus the resulting grain size of an alloy of this invention (Alloy 1 in Table 1) versus prior art alloys (Alloys 11 & 16 in Table 1). Alloys 11 and 16 were held at solution anneal temperatures for 30 seconds and Alloy 1 was held at solution anneal temperatures for 60 seconds. It can be seen from the graph that the alloy of this invention exhibits an improved resistance to grain growth at elevated solution anneal temperatures and thereby provides a larger processing window in manufacture that the prior alloys. This helps to reduce the cost of the alloy and improves its performance reliability of the alloy.

Referring to FIG. 2 there is shown a graph of yield strength versus aging response of two alloys of this invention (Alloys 2 & 17 in Table 1) versus a nickel silicon alloy (Alloy 18 in Table 1). The alloys were solution annealed at about 775° C. for 60 seconds, cold rolled about 40% reduction in thickness and age annealed at the indicated temperatures for about 3 hours. It is apparent that the alloys of this invention containing iron in specified amounts show a much flatter and therefore more consistent aging response over a wide temperature range. The iron addition clearly improves softening resistance during an age hardening anneal. This provides a more stable response to age annealing at finish gauge than the prior alloy and will help to reduce the cost of manufacturing the alloy and improve its reliability of performance.

The following explanations are believed to be the mechanisms which provide the improved process advantages for the alloys of this invention noted by reference to FIGS. 1 and 2, however, they are presented by way of possible explanations and the invention should not be deemed to be restricted or limited in any way by these explanations except as they may be claimed in the appended claims.

Scanning Electron Microscopy examination and EDAX analysis suggest that the improved process advantages offered by the alloys of this invention are traceable to the presence of a fine dispersion of nickel-iron-silicon rich second phase in the alloy strip. The chemistry of the alloys of this invention unexpectedly provides an intrinsically favorable dispersion of nickel-iron-silicon rich second phase with the processing of this invention. It is believed that the nickel-iron-silicon rich second phase restricts grain growth during solution annealing. This restriction of grain growth during solution annealing allows the alloys of this invention to develop a finer solution annealed grain size than comparable prior art alloys. If the alloys of this invention are processed to resolutionize the nickel-iron-silicon rich second phase dispersion, the grain growth observed during solutionizing treatments is similar to the prior art alloys without an iron addition. It is believed that the origin of the improved aging response of the alloys of this invention is related to the additional precipitation of nickel-iron-silicon rich phase during age annealing as well as improved softening resistance (probable restriction of dislocation movement) provided by nickel-iron-silicon rich second phase present in the microstructure prior to age annealing.

Generally such particles have a size of less than 1 micron and at a magnification of about 3500× the density of such particles is greater than 100 particles per 100 square micron area. Preferably such density is greater than 200 particles per 100 square micron area and most preferably such density is greater than 350 particles per 100 square micron area.

It has been found that cobalt may be substituted for iron on a 1:1 basis. Copper-nickel-silicon-tin alloys of this invention containing cobalt have improved resistance to grain growth during solution annealing as shown in FIG. 3, enhanced softening resistance during age annealing as shown in FIG. 4 and improved conductivity as shown in FIG. 5 respectively.

Referring to FIG. 3 there is shown a graph of solution anneal ("SA") temperature versus the resulting grain size of an alloy of this invention containing iron (Alloys 1 in Table 1), and an alloy of this invention containing cobalt (Alloy 7 in Table 1) versus prior art alloys (Alloys 11 & 16 ). Alloys 7, 11 and 16 were held at a solution anneal temperatures for 30 seconds and Alloy 1 was held at solution anneal temperatures for 60 seconds. It can be seen from the graph that the alloy of this invention containing cobalt exhibits a pronounced improvement in its resistance to grain growth at elevated solution anneal temperatures and thereby provides an even larger processing window during manufacture than the prior alloys and the alloys of the invention containing iron. This further helps to increase the processing limits for the alloy and improve the performance reliability of the alloy.

Referring to FIG. 4 there is shown a graph of yield strength in ksi versus aging response of two alloys of this invention containing iron (Alloys 2 & 17 in Table 1), an alloy of this invention containing cobalt (Alloy 7 in Table 1), versus a nickel silicon alloy (Alloy 18 in Table 1). The alloys were solution annealed at about 775° C. for 60 seconds, cold rolled about 40% and age annealed at the indicated temperatures for about 3 hours. It is apparent that the alloys of this invention containing iron in specified amounts show a much flatter aging response over a wide temperature range. The cobalt addition clearly improves softening resistance during age hardening by age annealing and increases yield strength as compared to the alloys of this invention containing iron alone. The presence of cobalt also provides a more stable response to age annealing at finished gauge than the prior art alloy. This further helps to increase the processing limits for the alloy and improve the performance reliability of the alloy.

Referring to FIG. 5 there is shown a graph of yield strength in ksi versus aging response of two alloys of this invention containing iron (Alloys 2 & 17 in Table 1), an alloy of this invention containing cobalt (Alloy 7 in Table 1), versus a nickel silicon alloy (Alloy 18 in Table 1). It is apparent that higher bell aging temperatures provide improved electrical conductivity. While iron or cobalt both tend to decrease conductivity the effect of cobalt is less than the effect of iron. The decrease in conductivity is not of a magnitude which would affect the application of these alloys in the electronics field especially with respect to connectors for automotive applications. For most connector applications the reduced sensitivity to cracking during localized plastic deformation and the improved stampability and stress relaxation properties of the alloys of this invention are of paramount importance.

Most preferably in accordance with this invention the sum of nickel, iron and cobalt contents is less than about 2.5%.

It is also believed that a minimum iron level of 0.3% will provide a superior combination of bend formability, strength, stress relaxation, and stampability.

The term "ksi" as used herein is an abbreviation for thousands of pounds per square inch. The term "mm" as used herein is an abbreviation for millimeters. Stress relaxation properties as set forth herein were tested with the strip oriented in the longitudinal direction which is the direction of rolling of the strip.

It is apparent that there has been provided in accordance with the invention a copper alloy that fully satisfies the objects, means and advantages set forth hereinabove. While the invention has been described in combination with embodiments thereof, it is apparent that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A copper alloy having a microstructure commensurate with an aged condition and improved resistance to cracking due to localized stress application, said alloy consisting essentially of:

from 0.7 to 3.5 weight percent nickel;

from 0.2 to 1 weight percent silicon;

from 0.05 to 1 weight percent tin;

from 0.26 to 1 weight percent iron; and the balance copper and unavoidable impurities wherein said copper has an electrical conductivity of greater than or equal to 37% IACS, a local ductility index of greater than 0.7 and a tensile elongation exceeding 5% in a 2 inch gauge length.

2. The copper alloy of claim 1 wherein said nickel is from 1.2 to 2.8 weight percent, said silicon is from 0.3 to 0.7 weight percent, said tin is from 0.2 to 0.6 weight percent, said iron is from 0.28 to 0.7 weight percent and further including an effective amount of manganese for improving hot workability up to 0.15 weight percent.

3. The copper alloy of claim 2 wherein said nickel is from 1.5 to 2.5 weight percent, said silicon is from 0.35 to 0.55 weight percent, said tin is from 0.3 to 0.5 weight percent, said iron is from 0.3 to 0.5 weight percent and manganese is from 0.02 to 0.1 weight percent.

4. The copper alloy of claim 1 wherein said alloy has a yield strength of from 60 to 100 ksi, stress relaxation resistance at 150° centigrade of at least 80% longitudinal stress remaining after 3000 hours exposure and excellent bend formability.

5. The copper alloy of claim 1 wherein cobalt is substituted, in whole or in part, on a 1:1 basis by weight, for iron.

6. The copper alloy of claim 5 wherein the total content of nickel, cobalt and iron is less than 2.5 percent by weight.

7. The copper alloy of claim 1 wherein an electrical connector component is formed from said copper alloy.

8. The copper alloy of claim 1 wherein said copper alloy has an average grain size of less than 0.015 millimeters.

9. The copper alloy of claim 8 wherein the average grain size of the alloy is no greater than 0.01 millimeters and the local ductility index of said alloy is at least 0.75.

10. The copper alloy of claim 8 wherein said copper alloy has a microstructure at finished gauge commensurate with a final age anneal at a temperature of between 400° C. and 550° C.

11. The copper alloy of claim 1 wherein the ratio of nickel to silicon is greater than 4.5:1.

12. The copper alloy of claim 11 wherein the ratio of nickel to silicon is greater than 5:1.

13. The copper alloy of claim 1 wherein said alloy contains nickel-iron-silicon-rich second phase particles, said particles having a size of less than 1 micron and, at a magnification of about 3500×, said particles having a density of greater than 100 particles per 100 square micron area.

14. A process for making a copper alloy comprising:

providing an alloy consisting essentially of:

from 0.7 to 3.5 weight percent nickel;

from 0.2 to 1 weight percent silicon;

from 0.05 to 1 weight percent tin;

from 0.26 to 1 weight percent iron; and the balance copper and unavoidable impurities;

casting said alloy into a desired shape;

solution annealing said alloys at a temperature of from 700° C. to 900° C. for a period of up to 5 minutes;

final cold working said alloy up to 50% reduction in thickness;

age annealing said alloy at a temperature of from 400° C. to 550° C. for a period of from 1 hour to 6 hours;

whereby said copper alloy is provided with a local ductility index of greater than 0.7, an electrical conductivity in excess of 37% IACS and a tensile elongation exceeding 5% in a 2 inch gauge length.

15. The process of claim 14 wherein said nickel is from 1.2 to 2.8 weight percent, said silicon is from 0.3 to 0.7 weight percent, said tin is from 0.2 to 0.6 weight percent, said iron is from 0.28 to 0.7 weight percent and further including an effective amount of manganese for improving hot workability up to 0.15 weight percent.

16. The process of claim 15 wherein said nickel is from 1.5 to 2.5 weight percent, said silicon is from 0.35 to 0.55 weight percent, said tin is from 0.3 to 0.5 weight percent, said iron is from 0.3 to 0.5 weight percent and manganese is from 0.02 to 0.1 weight percent.

17. The process of claim 16 wherein said alloy is provided with a yield strength of from 60 to 100 ksi, an electrical conductivity of greater than or equal to 35% IACS, stress relaxation resistance at 150° centigrade of at least 80% longitudinal stress remaining after 3000 hours exposure and excellent bend formability.

18. The process of claim 14 further including the step of substituting cobalt, in whole or in part, on a 1:1 basis by weight, for the iron.

19. The process of claim 14 further including the step of controlling the total content of nickel, cobalt and iron so that it is less than 2.5 percent by weight.

20. The process of claim 14 further including the step of forming said copper alloy into a connector.

21. The process as in claim 14 wherein prior to said solution annealing step said alloy is hot worked at a starting temperature in the range of 750° C. to 950° C. and thereafter the alloy is first cold worked from 50% to 90% reduction in thickness.

22. The process as in claim 21 wherein prior to the first cold working step said alloy is annealed at a temperature of 400° C. to 700° C. for from 1 hour to 16 hours.

23. The process as in claim 14 wherein in place of said solution anneal said alloy is annealed at a temperature of from 400° C. to 700° C. for about 1 hour to 6 hours, and wherein said final cold working step comprises from 30% to 50% reduction in thickness, and wherein in place of said aging anneal said alloy is relief annealed at a metal temperature of from 250° C. to 350° C. for about 30 seconds to about 5 hours.

24. The process of claim 14 wherein, the average final grain size of the alloy is no greater than 0.01 millimeters.

25. The process of claim 14 wherein said alloy has a local ductility index of at least 0.75.

26. A copper alloy formed by the process of:

casting a copper alloy that consists, by weight, essentially of from 0.7% to 3.5% nickel, 0.2% to 1% silicon, 0.05% to 1% tin, 0.26% to 1% iron and the balance copper and unavoidable impurities;

hot rolling said copper alloy at a temperature of between 750° C. and 950° C.;

cold rolling said copper alloy to a reduction in thickness of between 50% and 90%;

solution annealing said copper alloy at a temperature of between 700° C. and 900° C. for up to 5 minutes;

cold rolling said copper alloy to finished gauge; and age annealing said finished gauge copper alloy at a temperature of 400° C. and 550° C., whereby said finished gauge copper alloy has an electrical conductivity of greater than or equal to 37% IACS, a local ductility index of greater than 0.7 and a tensile elongation exceeding 5% in a 2 inch gauge length.

27. The copper alloy of claim 26 wherein said step of hot rolling is at a temperature of between 825° C. and 925° C.

28. The copper alloy of claim 26 wherein said step of solution annealing is at a temperature of between 750° C. and 850° C.

29. The copper alloy of claim 28 wherein said step of solution annealing is for between 30 seconds and 60 seconds.

30. The copper alloy of claim 26 wherein said step of cold rolling to finished gauge is a 10%–20% reduction in thickness.

31. The copper alloy of claim 30 wherein said step of annealing said finished gauge copper alloy is at a temperature of from 400° C. to 500° C.

32. The copper alloy of claim 31 wherein said step of annealing said finished gauge copper alloy is for a time of for between 2 hours and 4 hours.

33. A copper alloy having a microstructure commensurate with an aged condition and improved resistance to cracking due to localized stress application, said alloy consisting essentially of:

from 0.7 to 3.5 weight percent nickel;

from 0.2 to 1 weight percent silicon;

from 0.05 to 1 weight percent tin;

from 0.3 to 1 weight percent iron; and the balance copper and unavoidable impurities wherein said copper has an electrical conductivity of greater than or equal to 37 percent IACS, a local ductility index of greater than 0.7 and a tensile elongation exceeding 5% in a two-inch gauge length.

34. The copper alloy of claim 33 wherein said nickel is from 1.2 to 2.8 weight percent, said silicon is from 0.3 to 0.7 weight percent, said tin is from 0.2 to 0.6 weight percent, said iron is from 0.3 to 0.7 weight percent and further including an effective amount of manganese for improved hot workability up to 0.5 weight percent.

35. The copper alloy of claim 34 wherein said nickel is from 1.5 to 2.5 weight percent, said silicon is from 0.35 to 0.55 weight percent, said tin is from 0.3 to 0.5 weight percent, said iron is from 0.3 to 0.5 weight percent and said manganese is from 0.02 to 0.1 weight percent.

36. The copper alloy of claim 33 wherein said alloy has a yield strength of from 60 to 100 ksi, stress relaxation resistance at 150° C. of at least 80 percent longitudinal stress remaining after 3,000 hours exposure and excellent bend formability.

37. The copper alloy of claim 33 wherein cobalt is substituted, in whole or in part, on a 1:1 basis by weight, for iron.

* * * * *